US010361052B1

(12) United States Patent
Rodriguez Salinas et al.

(10) Patent No.: US 10,361,052 B1
(45) Date of Patent: Jul. 23, 2019

(54) SILVER NANO PARTICLE JOINT USED TO FORM COMPOSITE CONTACT FOR USE IN A CIRCUIT BREAKER

(71) Applicant: Siemens S.A. de C.V., Mexico (MX)

(72) Inventors: Juan Jose Rodriguez Salinas, Monterrey (MX); Perla Rodriguez Camarillo, Guadalupe (MX); Eduardo Cardenas, San Nicolas de los Garza (MX)

(73) Assignee: SIEMENS INDUSTRY, INC., Alpharetta, GA (US)

( * ) Notice: Subject to any disclaimer, the term of this patent is extended or adjusted under 35 U.S.C. 154(b) by 0 days.

(21) Appl. No.: 15/898,963

(22) Filed: Feb. 19, 2018

(51) Int. Cl.
*H01H 69/00* (2006.01)
*H01H 71/08* (2006.01)

(52) U.S. Cl.
CPC ..... *H01H 69/00* (2013.01); *H01H 71/08* (2013.01); *H01H 2201/024* (2013.01); *H01H 2203/014* (2013.01); *H01H 2203/026* (2013.01); *H01H 2203/04* (2013.01)

(58) Field of Classification Search
CPC ..... H01H 1/02; H01H 1/021; H01H 11/043; H01H 11/045; H01H 11/048; H01H 2203/00; H01H 2300/036; C08J 5/005; B22F 2202/06; B22F 2301/255; B22F 2303/35; B22F 2304/05
See application file for complete search history.

(56) References Cited

U.S. PATENT DOCUMENTS 4,417,119 A * 11/1983 Okuda ..... B23K 1/0004 219/72
5,334,809 A * 8/1994 DiFrancesco ..... B23K 20/16 200/262
9,318,277 B2 * 4/2016 Malacara-Carrillo ..... H01H 1/023

* cited by examiner

*Primary Examiner* — Vanessa Girardi

(57) ABSTRACT

A circuit breaker comprises a contact and a line terminal configured that are bound in an assembly using a silver nanoparticles (Np—Ag) material that is synthesized by reducing a precursor salt in presence of a reducing agent. The contact comprises a silver alloy material having a first surface. The line terminal comprises a non-ferrous material having a second surface such that a plurality of drops of the silver nanoparticles (Np—Ag) material synthesized using a green chemistry process are applied in an interface between the first surface of the contact and the second surface of the line terminal by performing a resistance projection welding to bind the two components.

10 Claims, 9 Drawing Sheets

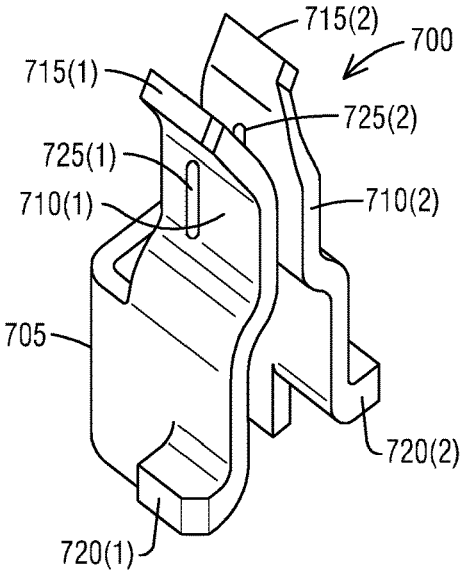
FIG. 7
FIG. 8
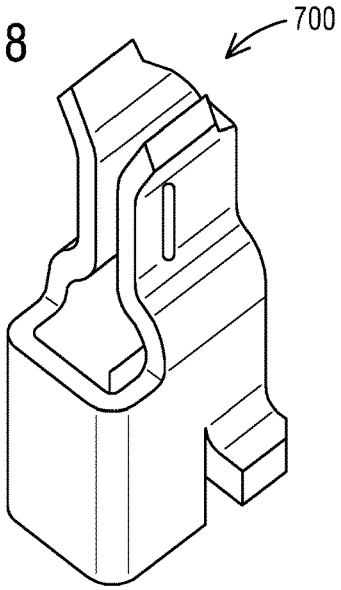
FIG. 9
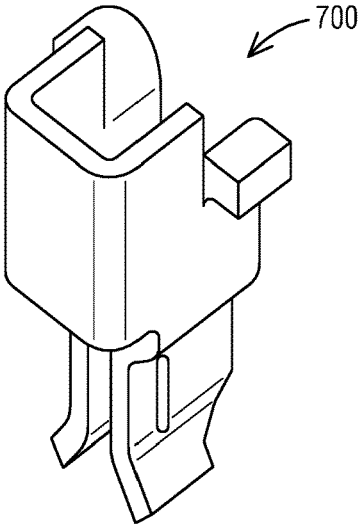
FIG. 10
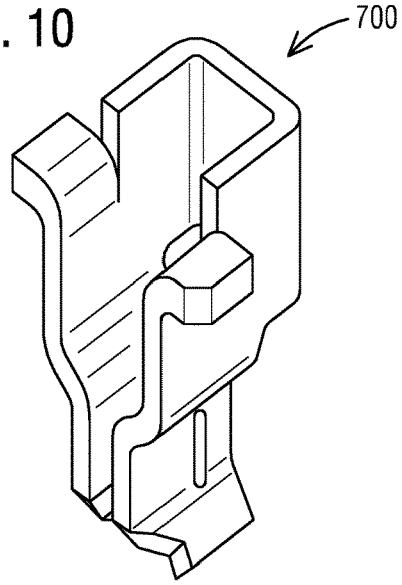

SILVER NANO PARTICLE JOINT USED TO FORM COMPOSITE CONTACT FOR USE IN A CIRCUIT BREAKER

BACKGROUND

1. Field

Aspects of the present invention generally relate to assembling two electrically conductive components such as a contact and a line terminal of a circuit breaker with a silver nano particles material based joint.

2. Description of the Related Art

SIL FOS® offers bulk or pre-packaged lots of filler metals for brazing copper-based alloys, steels, and stainless steels. This group of alloys facilitates the joining of copper to copper without a flux and copper-based alloys (brass and bronze) with a flux. SIL-FOS® is the workhorse filler metal used in the refrigeration and air conditioning industry. Best alloy for general purpose copper-copper brazing in the SIL-FOS® family. For copper-to-copper joints the phosphorus in the SIL-FOS® product serves as the fluxing agent and no separate flux is necessary. For brass application however, flux is recommended. For use where close fit-ups cannot be maintained SIL-FOS® 15 works well to "bridge" gaps.

A joint of a contact to a line terminal is typically created by SIL-FOS® material between them. However, when the SIL FOS® material is insufficient or not melted by the heat feed the contact is not fixed correctly to the line terminal. This problem creates missing contacts in the UL certification and an overheating problem is caused by the high resistance created by voids between the contact and the line terminal.

Until today to obtain a better performance in the joints of the contacts and the line terminals, use of quality tools is required to ensure a correct quantity of use of the SIL-FOS® material in these joints. Besides this it is possible to modify the energy supplied to a heat source and the time this heat it is applied to modify how the SIL-FOS material is melted. These steps help to overcome some defects encountered in the production of the joints with the SIL-FOS® material. However, methods and apparatus that reduce the above set forth issues in assembling two circuit breaker components with the SIL-FOS® material are desirable.

Therefore, there is a need for a manufacturing material and/or a process that creates almost defect-free joints between two electrically conductive components of a circuit breaker and is also a more controllable and stable method of joining for forming an assembly.

SUMMARY

Briefly described, aspects of the present invention relate to using a silver nano particles material for joining two electrically conductive components of a circuit breaker (e.g., a stationary contact and a line terminal) without an aid of coated projections of materials of first and second components that are used for brazing based on filler metals. The silver nano particles material is a more controllable and stable method of joining for forming an assembly of the circuit breaker. The silver nano particles material can withstand a lot of mechanical pressure and doesn't suffer of any voids due to high thermal conditions of operation.

In accordance with one illustrative embodiment of the present invention, a method of assembling two electrically conductive components such as a contact and a line terminal of a circuit breaker with a silver nano particles material based joint is provided. The method comprises providing a first component of a circuit breaker comprising a silver alloy material, the first component having a first surface, providing a second component of the circuit breaker comprising a non-ferrous material, the second component having a second surface, applying silver nanoparticles (Np—Ag) in an interface between the first surface of the first component and the second surface of the second component, performing a resistance projection welding with a current and a pressure using the silver nanoparticles (Np—Ag) to bind the first component to the second component in an assembly by increasing a temperature of the interface with a heat generated by an electric resistance of the silver alloy material and the non-ferrous material without an aid of coated projections of materials of the first and second components that are used for brazing based on filler metals and assembling the circuit breaker using the assembly of the first and second components.

In accordance with another illustrative embodiment of the present invention, a method of assembling a circuit breaker is provided. The method comprises synthesizing silver nanoparticles (Np—Ag) using a green chemistry process, disposing a contact of the circuit breaker and a line terminal of the circuit breaker proximate to each other, depositing a plurality of drops of silver nanoparticles (Np—Ag) between respective first and second surfaces of the contact and the line terminal to form a bond, drying the plurality of drops of silver nanoparticles (Np—Ag) on the first and second surfaces of the bond, forming an electrically conductive structure having a shape from a union of the contact and the line terminal using a resistance welding process and disposing the electrically conductive structure within a housing of the circuit breaker.

In accordance with another illustrative embodiment of the present invention, a circuit breaker is provided. The circuit breaker comprises a contact configured to electrically connect with a connector and a line terminal configured to connect with the contact by a direct physical contact. The contact comprises a silver alloy material and has a first surface. The line terminal comprises a non-ferrous material and has a second surface such that a plurality of drops of silver nanoparticles (Np—Ag) are applied in an interface between the first surface of the contact and the second surface of the line terminal by performing a resistance projection welding.

BRIEF DESCRIPTION OF THE DRAWINGS

FIG. 7 illustrates a perspective view of a line terminal in accordance with an exemplary embodiment of the present invention.

FIG. 8 illustrates a perspective view of the line terminal shown in FIG. 7 in accordance with an exemplary embodiment of the present invention.

FIG. 9 illustrates a perspective view of the line terminal shown in FIG. 7 in accordance with an exemplary embodiment of the present invention.

FIG. 10 illustrates a perspective view of the line terminal shown in FIG. 7 in accordance with an exemplary embodiment of the present invention.

DETAILED DESCRIPTION

To facilitate an understanding of embodiments, principles, and features of the present invention, they are explained hereinafter with reference to implementation in illustrative embodiments. In particular, they are described in the context of a manufacturing process of assembling two components of a circuit breaker with a silver nanoparticles material. Embodiments of the present invention, however, are not limited to use in the described devices or methods.

The components and materials described hereinafter as making up the various embodiments are intended to be illustrative and not restrictive. Many suitable components and materials that would perform the same or a similar function as the materials described herein are intended to be embraced within the scope of embodiments of the present invention.

Figure 1:
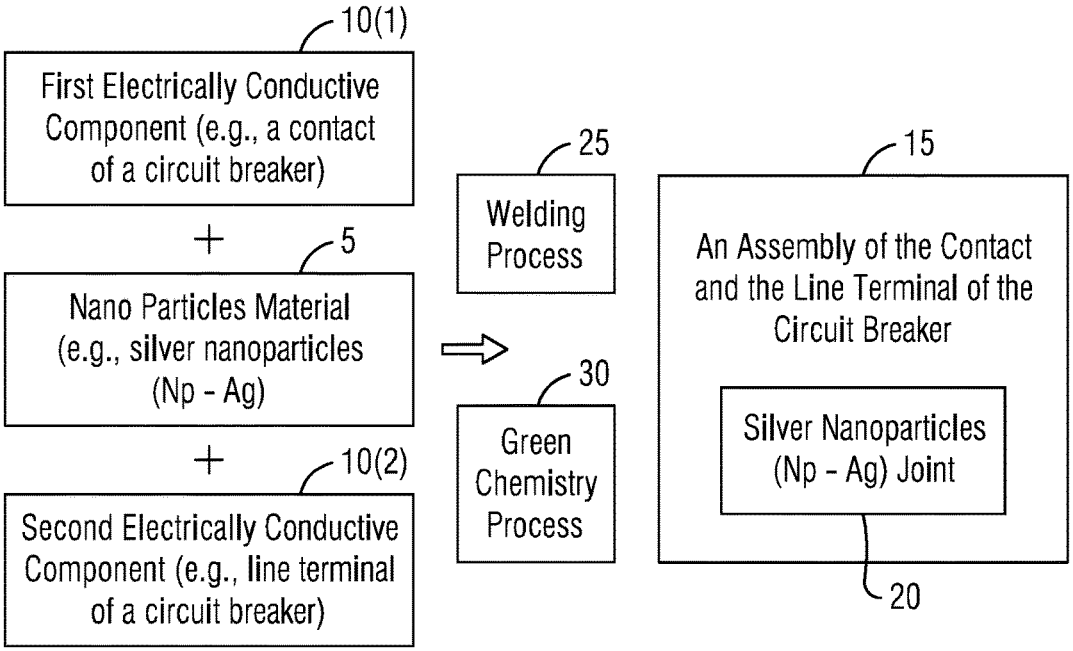
FIG. 1 illustrates a schematic block diagram of a manufacturing process of using a nano particles material for joining two electrically conductive components of a circuit breaker into an assembly (e.g., a stationary contact and a line terminal) with a nano particles joint in accordance with an exemplary embodiment of the present invention.

Consistent with one embodiment of the present invention, FIG. 1 represents a schematic block diagram of a manufacturing process of using a nanoparticles material 5 for joining first and second electrically conductive components 10(1-2) of a circuit breaker (not shown) into an assembly 15 (e.g., an assembly of a stationary contact and a line terminal) with a nanoparticles joint 20 in accordance with an exemplary embodiment of the present invention. Examples of the nanoparticles material 5 include silver nanoparticles (Np—Ag). For example, binding of a 50% W-50% Ag contact to a Cu line terminal with an electrolytic coating of Ag may be performed using a resistance projection welding (RPW) process 25 and incorporating the silver nanoparticles (Np—Ag) at an interface before binding. The silver nanoparticles (Np—Ag) may be synthesized in a laboratory using a green chemistry process 30.

The most common methods for the nanoparticles material 5 synthesis fall under the category of wet chemistry, or the nucleation of particles within a solution. This nucleation occurs when a silver ion complex, usually $AgNO_3$ or $AgClO_4$, is reduced to colloidal silver in the presence of a reducing agent. When the concentration increases enough, dissolved metallic silver ions bind together to form a stable surface. The surface is energetically unfavorable when the cluster is small, because the energy gained by decreasing the concentration of dissolved particles is not as high as the energy lost from creating a new surface. When the cluster reaches a certain size, known as the critical radius, it becomes energetically favorable, and thus stable enough to continue to grow. This nucleus then remains in the system and grows as more silver atoms diffuse through the solution and attach to the surface. As the particles grow, other molecules in the solution diffuse and attach to the surface. This process stabilizes the surface energy of the particle and blocks new silver ions from reaching the surface.

There are many different wet synthesis methods, including the use of reducing sugars, citrate reduction, reduction via sodium borohydride, the silver mirror reaction, the polyol process, seed-mediated growth, and light-mediated growth. Each of these methods, or a combination of methods, will offer differing degrees of control over the size distribution as well as distributions of geometric arrangements of the nanoparticle. For example, a wet-chemical technique has been developed as a green ultrasonically-assisted synthesis. Under ultrasound treatment, silver nanoparticles (Np—Ag) are synthesized with K-carrageenan as a natural stabilizer. The reaction is performed at ambient temperature and produces silver nanoparticles (Np—Ag) with fcc crystal structure without impurities. The concentration of K-carrageenan is used to influence particle size distribution of the Np-Ags.

Examples of the first electrically conductive component 10(1) include a stationary contact of a circuit breaker. A circuit breaker is an automatically operated electrical switch designed to protect an electrical circuit from damage caused by excess current, typically resulting from an overload or short circuit. Its basic function is to interrupt current flow after a fault is detected. A single pole switch has one moving arm and one stationary contact. Silver tungsten is by far the most popular of the contact material families used in circuit breakers and other power switching devices. The superior conductivity of the silver combined with the ability of tungsten to withstand mechanical and electrical wear make this the ideal material for use in oxidizing atmospheres and where severe arcing is anticipated. The silver tungsten contact materials range from a low of 10% silver to a high of 90% silver. In addition to varying the composition, One can modify the contact material by changing process parameters. This may include changing particle size, furnace temperatures, as well as the addition of additives.

Examples of the second electrically conductive component 10(2) include a line terminal of a circuit breaker. A line feeds a main breaker in a circuit breaker panel. The line is connected to the line terminal of the circuit breaker. In accordance with one aspect of the disclosed concept, an electrical switching apparatus such as a circuit breaker includes a line terminal. The circuit breaker includes a stationary contact and a movable contact structured to move into and out of engagement with the stationary contact in order to close and open the circuit breaker, respectively. The line terminal comprises a lip portion structured to be connected to the stationary contact in order to provide an electrical pathway therebetween and an arm portion extending from the lip portion. The arm portion has an engaging portion structured to receive and engage a conductive post member and provide an electrical pathway between the conductive post member and the stationary contact. The line terminal further comprises a neck portion extending from the arm portion and a tab portion extending from the neck portion and being located internal with respect to the engaging portion.

Examples of the nanoparticles joint 20 include a silver nanoparticles (Np—Ag) joint. The silver nanoparticles (Np—Ag) of the nanoparticles joint 20 may be about tens of nm diameter and prepared by chemical reduction reaction. The thermal characteristics of the nanoparticles (Np—Ag) joint 20 may be measured by thermogravimetric analysis (TGA) and differential scanning calorimetry (DSC). A low-temperature sintering bonding processes using the silver nanoparticles (Np—Ag) material may be carried out at a temperature range of hundreds of ° C. for few minutes under the pressure of few MPa. The microstructures of the sintered joint 20 and the fracture morphology may be evaluated by scanning electron microscopy (SEM). The shear strength may be used to evaluate the mechanical property of the sintered joint 20. The shear strength of the nanoparticles (Np—Ag) joint 20 could meet the requirements of a circuit breaker working at high temperature. The joint shear strength may be increased with an increase of a sintering temperature due to much denser sintered nanoparticles (Np—Ag) and more comprehensive metallurgical bonds formed in the nanoparticles (Np—Ag) joint 20.

Figure 2:
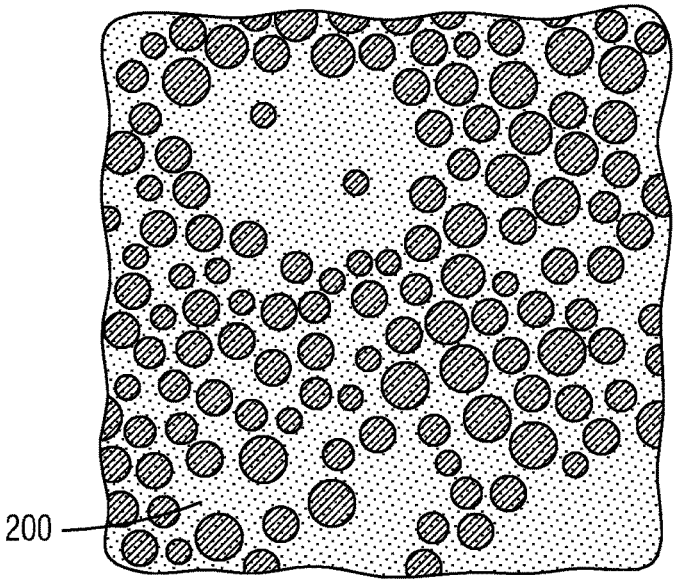
FIG. 2 illustrates a schematic diagram of a silver nano particles material in accordance with an exemplary embodiment of the present invention.

Referring to FIG. 2, it illustrates a schematic diagram of a silver nanoparticles (Np—Ag) material 200 in accordance with an exemplary embodiment of the present invention. The silver nanoparticles (Np—Ag) material 200 have unique optical, electrical, and thermal properties and are being incorporated as fillers which utilize silver nanoparticles for their high electrical conductivity, stability, and low sintering temperatures. The silver nanoparticles (Np—Ag) material 200 are nanoparticles of silver of between 1 nm and 100 nm in size. While frequently described as being 'silver' some are composed of a large percentage of silver oxide due to their large ratio of surface-to-bulk silver atoms. Numerous shapes of nanoparticles can be constructed depending on the application at hand. Commonly used are spherical silver nanoparticles but diamond, octagonal and thin sheets are also popular. Their extremely large surface area permits the coordination of a vast number of ligands (an ion or molecule attached to a metal atom by coordinate bonding or a molecule that binds to another (usually larger) molecule).

In one embodiment, the use of the silver nanoparticles (Np—Ag) material 200 as a joint material permits a more controllable and stable method to join a contact to a line terminal. This process prevents the contacts to fail in the UL certification process, since the application of the silver nanoparticles is a controlled process which prevents any voids between the contact and the line terminal.

Since the quantity of nanoparticles to be applied can be controlled, this will help to ensure good bonding between the line terminal and the contact. The nanoparticles are applied to the contact such that the silver material is applied uniform in the surface of the contact, ensuring the joint will perform as required.

A test to evaluate the performance of this method was performed such as a test was performed for a shear test. The minimum force necessary to remove the contact is 200 lb. In other prototypes the minimum force required to remove the contact was 306 lb. The contact with the nanoparticles was tested using the UL489 certification. In this case when the silver nanoparticles (Np—Ag) material 200 were used, the contacts fixed by this process were able to perform satisfactory the X, Y, Z sequence.

The synthesis of the silver nanoparticles (Np—Ag) material 200 may be carried out using a green chemistry methodology to obtain nanomaterials from non-polluting compounds. The materials used may be: silver nitrate (AgNO3) as a precursor salt and a coriander leaf extract may be used as a reducing agent. The extraction of the coriander extract may be carried out in the following manner. The coriander leaves were reduced in their size using a porcelain mortar. Then 100 gm of coriander leaves may be boiled in 250 ml of distilled water for 20 minutes and the solution can be then filtered. The procedure may be repeated to add 100 gm of additional coriander leaves. Finally, the final solution may be allowed to stand at room temperature.

A stock solution of 100 mM AgNO3 may be prepared for the preparation of the Np—Ag, from which a 10 mM dilution may be prepared. About 2.5 ml of the coriander extract may be mixed with 50 ml of 10 mM AgNO3 solution and stirred for 10 minutes at room temperature. The obtained solution is then heated to 65° C. for 10 minutes. Finally the solutions were centrifuged at 3500 rpm for 10 minutes and ultrasound may then be used for 30 minutes in each of the solutions to facilitate the suspension of Np—Ag in the aqueous medium.

For characterization of the silver nanoparticles (Np—Ag) material 200, a formation of Np—Ag may be confirmed using a UV-Visible spectra and analyzing its x-ray diffraction pattern. A Vernier SpectroVis Plus spectrophotometer and Logger Pro software may be used to obtain an absorbance spectra using a wavelength scan of 300 to 800 nm. Finally, a Rigaku Miniflex 600 X-ray diffractometer may be used, using a voltage of 30 kV, 15 mA current, Miniflex Guidance software and PDX-L for identification of the obtained compounds.

The preparation of the sample may be performed as follows. The solution is poured into a sample holder of the equipment and a dryer was subsequently used to ensure homogeneous drying. This procedure may be performed consecutively until the sample holder was considered to have sufficient sample amount.

Figure 3:
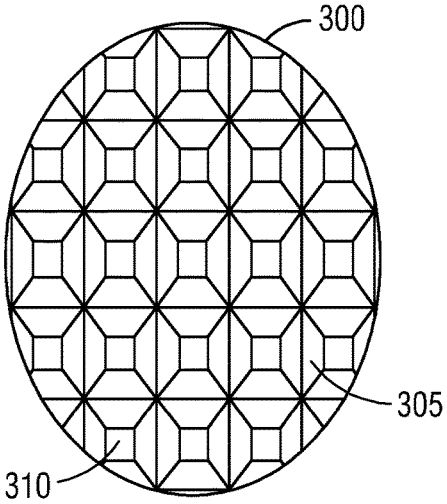
FIG. 3 illustrates a front view of a stationary contact in accordance with an exemplary embodiment of the present invention.

Turning now to FIG. 3, it illustrates a front view of a stationary contact 300 in accordance with an exemplary embodiment of the present invention. The stationary contact 300 may be a metal part that makes and breaks a connection in an electrical circuit of a circuit breaker. The stationary contact 300 may be made of elemental metals, composites, or alloys that are made by powder metallurgy (PM) processes. The stationary contact 300 may include a surface or an edge 305 with serrations 310. This surface or the edge 305 is to be welded to another component such as a line terminal. In particular, welding to form a joint of the stationary contact 300 is assisted by the serrations 310 on the surface or the edge 305 by resulting in a relatively more stronger bond than without serrations. More specifically, the stationary contact 300 has the serrations 310 to provide small areas at and around which considerable heat is generated when the stationary contact 300 is welded.

Figure 4:
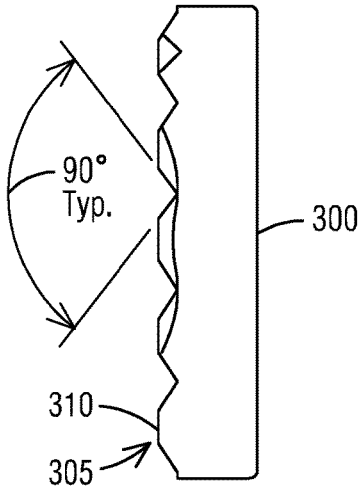
FIG. 4 illustrates a side view of the stationary contact shown in FIG. 3 in accordance with an exemplary embodiment of the present invention.

In particular, FIG. 4 illustrates a side view of the stationary contact 300 shown in FIG. 3 in accordance with an exemplary embodiment of the present invention. The serrations 310 may be formed having an angle of 90 degrees in separation of adjacent edges of pins or tips which define a facing surface of the serrations 310. In addition, the serrations 310 may be formed having a uniform pattern 400 being consistent across the surface or the edge 305 of the stationary contact 300 to provide a more stronger bond than a case where the serrations 310 are absent and the surface or the edge 305 is just plain or smooth or flat.

Figure 5:
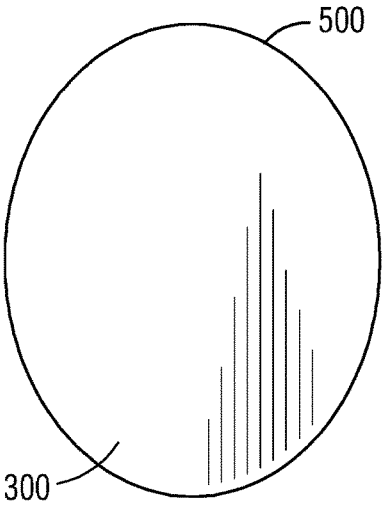
FIG. 5 illustrates a top view of the stationary contact shown in FIG. 3 in accordance with an exemplary embodiment of the present invention.

As seen in FIG. 5, it illustrates a top view of the stationary contact 300 shown in FIG. 3 in accordance with an exemplary embodiment of the present invention. As indicated, this embodiment of the stationary contact 300 is a round-shaped contact 500. Other sizes and/or shapes of the stationary contact 300 are also possible and within the scope of the present invention as they can be obtained without deviting from the spirit of instant invention.

Figure 6:
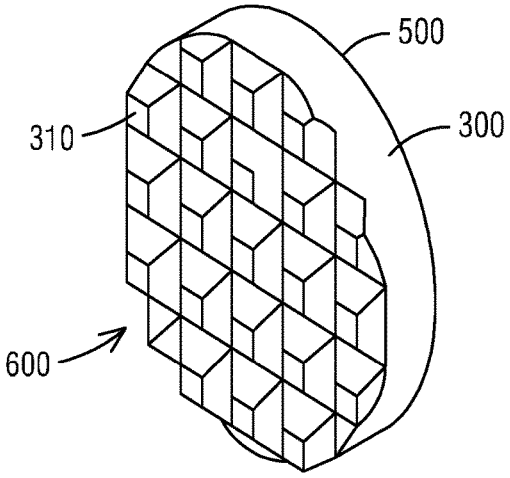
FIG. 6 illustrates a perspective view of the stationary contact shown in FIG. 3 in accordance with an exemplary embodiment of the present invention.

As shown in FIG. 6, it illustrates a perspective view of the stationary contact 300 shown in FIG. 3 in accordance with an exemplary embodiment of the present invention. As illustrated, this embodiment of the stationary contact 300 is the round-shaped contact 500 having a bond-facing surface 600 of the serrations 310.

In FIG. 7, it illustrates a perspective view of a line terminal 700 in accordance with an exemplary embodiment of the present invention. The line terminal 700 is configured to control contact mating and mechanism operation. The line terminal 700 comprises a contact face 705 that is configured to receive the stationary contact 300. The contact face 705 defines a flat surface projecting outwardly away from first and second legs 710(1-2) of the line terminal 700. The legs 710(1-2) provide an electrical pathway between a conductive post member of a circuit breaker and the stationary contact 300.

Each leg 710 includes a corresponding lip 715 of first and second lips 715(1-2) at a bottom end of the line terminal 700. The lips 715(1-2) bend away from a central axis of the line terminal 700 being present in middle of the whole structure of the line terminal 700. Each leg 710 includes a corresponding tab 720 of first and second tabs 720(1-2) at a top end of the line terminal 700. The tabs 720(1-2) extend away from the central axis of the line terminal 700 being present in middle of the whole structure of the line terminal 700. The line terminal 700 further comprises holes 725(1-2) in the legs 710(1-2) of which only one hole is visible in FIG. 7 while other hole is not seen as it is hidden from the view.

With reference to FIG. 8, it illustrates a perspective view of the line terminal 700 shown in FIG. 7 in accordance with an exemplary embodiment of the present invention. The perspective view of the line terminal 700 is shown from a bottom side of the line terminal 700.

With regards to FIG. 9, illustrates a perspective view of the line terminal 700 shown in FIG. 7 in accordance with an exemplary embodiment of the present invention. The perspective view of the line terminal 700 is shown from a top side of the line terminal 700.

FIG. 10 illustrates a perspective view of the line terminal 700 shown in FIG. 7 in accordance with an exemplary embodiment of the present invention. The perspective view of the line terminal 700 is shown from an inner side of the line terminal 700. The line terminal 700 may comprise a non-ferrous material, e.g., the line terminal 700 may comprise a Copper (Cu) line terminal with an electrolytic coating of Silver (Ag) thereon.

Figure 11:
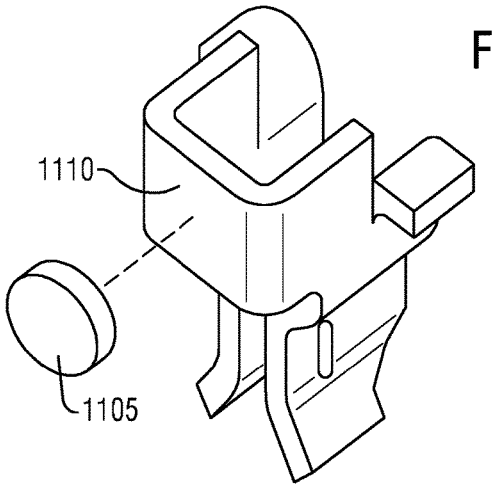
FIG. 11 illustrates a perspective view of a manufacturing setup of making an assembly of a round stationary contact and a C-clip type line terminal in accordance with an exemplary embodiment of the present invention.

FIG. 11 illustrates a perspective view of a manufacturing setup of making an assembly 1100 (shown in FIG. 12) of a round stationary contact 1105 and a C-clip type line terminal 1110 in accordance with an exemplary embodiment of the present invention. The round stationary contact 1105 may comprise 50% W-50% Ag and the C-clip type line terminal 1110 may be a Cu line terminal with an electrolytic coating of Ag.

The silver nanoparticles (Np—Ag) material 200 may be synthesized in a laboratory using green chemistry. The characterization of the silver nanoparticles (Np—Ag) material 200 by SEM and UV-visible spectro-photometry may be performed. After the welding process with a current of 14 KA and a pressure of 0.1 MPA, a standard test of application of cut resistance may be realized. The results found may exceed the minimum value of 200 lb in all cases. It is concluded that the best results were obtained by applying 7 and 13 drops of silver nanoparticles (339-440 lbs).

The binding of the round stationary contact 1105 of 50% W-50% Ag to the C-clip type line terminal 1110 being a Cu line terminal with an electrolytic coating of Ag may be performed using a resistance projection welding (RPW) process and incorporating silver nanoparticles at their interface before binding. Resistance welding is a welding technique commonly used in industry and conventionally applied to flat geometries of ferrous metals. The concept of joining this technique is based on increasing the temperature of the interface with the heat generated by the electric resistance. This technique has the advantage of lasting small periods of time. In recent years, resistance welding has been applied in the manufacture of electrical devices. However, these devices are made of non-ferrous materials such as copper or aluminum, which have low electrical resistivity. In particular, the electrical resistance at room temperature is in the values of 10.1, 1.694 and 2.67 [μQ·cm], in the case of steel, copper and aluminum.

The heat generated by the electrical resistivity is obtained from the following equation:

$$Q=I^2Rt \quad (1)$$

Where:

Q=Heat generated

I=Current

R=Electrical resistance of the material t=Union time

According to the above equation (1), the heat generated is proportional to the electrical resistance. Therefore, non-ferrous materials are difficult to heat due to their low electrical resistance, and therefore make them harder to carry to their melting point to achieve bonding using conventional resistance welding. As for the bonding methods for materials of low electrical resistivity, sintering has been the main focus because they operate at temperatures lower than their melting point.

During a sintering process, materials made by powder metallurgy become a coherent mass upon heating without melting. Silver nanoparticles are known as sintering material for the packaging of power electronics because silver has better thermal and electrical conductivity than commonly used. Because there are fewer atoms per particle and the surface area to volume ratio is high, the sintering temperature is lower for nanoparticles than for conventional materials due to their high surface energy. Therefore, if nanoparticles are used using the resistance projection welding (RPW) method to bond non-ferrous materials, the bond may be generated in a short period of time and at temperatures lower than the melting point of the materials to be bonded. Therefore, if nanoparticles are used using this bonding method (RPW) for bonding non-ferrous materials, the bonding can be generated in a short period of time and temperatures lower than the melting point of the materials to be bonded.

One of the objective of the present invention is to connect the round stationary contact 1105 formed by 50% W-50% Ag and the C-clip type line terminal 1110 formed as a silver-coated copper line terminal, using nanoparticles between the two surfaces as they cannot currently be joined without an aid of the coated projections of their material of contribution called SIL-FOS®.

In one of the embodiment of the present invention, for the deposition of the silver nanoparticles (Np—Ag) material 200 on a surface of the round stationary contact 1105 made of 50% W-50% Ag, the surface of the bond was prepared. For this purpose, the surface of the round stationary contact 1105 was sanded until the projections were eliminated, eliminating the coating of SIL-FOS® and also obtaining a flat surface. Later they may be polished to eliminate the irregularities caused by the sanding. Having an appropriate surface, the silver nanoparticles (Np—Ag) material 200 with a concentration of 10 mM were deposited on the polished surface. For this procedure, it is necessary to deposit the silver nanoparticles (Np—Ag) material 200 drop by drop. Therefore, two drying methods may be used: (1). a hair dryer method and (2). a comal drying method. Using a number of drops, a duplicate of samples was prepared which carried the following number of drops: 1, 3, 7, 13 and 20.

A characterization by SEM of the contact with Np—Ag material may be done. The morphology and distribution of the Np—Ag material on the round stationary contact 1105 may be observed using a scanning electron microscope (SEM).

With regards a method of making a union any suitable resistance welding machines may be used to make the connection. For example, a current of 14 kA and a pressure of 0.1 MPa may be used. For each cycle, the type of external cooling, which consists of externally cooling the electrodes with water, may be used.

For a cut resistance test, the union may be evaluated using a quality test standard of the union of a company. The shear strength should be equal to or greater than 200 lbs.

At nanometric levels, properties such as a size and an agglomeration state are very important for the optical properties of metallic nanoparticles. Based on the maximum absorption peaks and their wavelength the size of the nanoparticles can be determined. In our case, the expected wavelength values for the silver nanoparticles (Np—Ag) material 200 are in the 400-500 nm.

To perform a characterization analysis, the spectrum of the coriander extract may first be observed to have it as a reference when compared to the spectrum of the Np—Ag solution and thus to determine the size range of the nanoparticles.

It experiments, the maximum absorbance peak of the coriander extract is found at approximately 400 nm. The absorbance peaks in the Np—Ag spectrum may be found at approximately 400 nm and 460 nm. A first peak may be due to the low presence of coriander extract, while the second peak, which has an absorbance of 0.6, represents the presence of silver nanoparticles. According to the literature, the peak absorbance at 460 nm is representative of the Np—Ag of 60-80 nm in size.

An analysis of the diffraction pattern of a prepared sample may be carried out, in order to confirm that silver nanoparticles were indeed produced. An X-ray diffraction pattern may be obtained. The presence of the peaks of 37.9°, 44.05°, 64.35° and 77.4° may correspond to the planes of silver (111), (200), (220) and (311), respectively. Therefore, a XRD can confirm a crystal structure of the silver nanoparticles (Np—Ag) material 200.

In a characterization by SEM of the round stationary contact 1105 with the Np—Ag nanoparticles, a distribution of nanoparticles on a surface of the contact is may be controlled by applying and drying few such as 2 drops of a Np—Ag nanoparticles material solution. A drying method is relevant for the surface obtained. Using a drying method involving a comal gives a surface of continuous roughness while with a dryer method the most dispersed nanoparticles are obtained. Accordingly, a desired distribution of the Np—Ag nanoparticles material throughout the round stationary contact 1105 may be obtained.

A test of a shear strength of a union of the round stationary contact 1105 may also be done. The union between the round stationary contact 1105 formed by 50% W-50% Ag and the C-clip type line terminal 1110 such as a copper (Cu) line terminal is achieved by depositing the silver nanoparticles (Np—Ag) material 200 between the two surfaces of the round stationary contact 1105 and the C-clip type line terminal 1110. In order to assess the quality of the union, a shear stress test may be performed which in one embodiment requires a value greater than the shear stress of 200 lb as a parameter. The following table TABLE I shows the results obtained: TABLE I

TABLE I

| Number of Sample | Current [A] | Presion [Mpa] | Drying method | Drops number | Shear Stress (lb) |
|---|---|---|---|---|---|
| 1 | 14000 | 0.1 | Dryer | 2 | 328 |
| 2 | | | method | 3 | 206 |
| 3 | | | | 3 | 471 |
| 4 | | | | 7 | 207 |
| 5 | | | | 13 | 128 |
| 6 | | | | 13 | 162 |
| 7 | | | | 20 | 236 |
| 8 | | | | 20 | 272 |
| 9 | | | Comal drying | 1 | 259 |
| 10 | | | method | 7 | 450 |
| 11 | | | | 7 | 363 |
| 12 | | | | 13 | 368 |
| 13 | | | | 13 | 339 |
| 14 | | | | 20 | 344 |
| 15 | | | | 20 | 465 |

According to the results obtained, as shown in the TABLE I above, a drying method is fundamental for the distribution of the silver nanoparticles (Np—Ag) material 200 deposited by a number of drops. The best yields were those dried by the comal drying method, which obtained more constant values that are in the range of shear stress of 259-465 lbs. In these samples it is observed that as the number of drops increases, the strength of the bond increases, obtaining the best results in the contact prepared with 7 drops, however, if it were to be implemented as a bonding method it would be advisable to consider 13 drops as well, which can increase the strength of the nanoparticles (Np—Ag) joint 20.

Additionally, all the contacts tested were joined however a variation in the mechanical strength of the union with the number of drops and a drying method is observed. In conclusion, the silver nanoparticles (Np—Ag) material 200 may be used for the bonding of the round stationary contact 1105 of 50% W-50% Ag and the surface of and the C-clip type line terminal 1110. The best results of the mechanical strength were obtained by applying and drying 7 and 13 drops of the silver nanoparticles (Np—Ag) material 200 having the shear stress in a range of 339-440 lbs.

Figure 12:
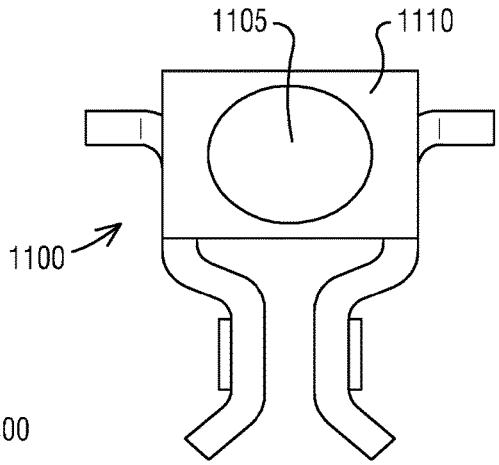
FIG. 12 illustrates a front view of an assembly of the round stationary contact and the C-clip type line terminal of FIG. 11 in accordance with an exemplary embodiment of the present invention.

FIG. 12 illustrates a front view of the assembly 1100 of the round stationary contact 1105 and the C-clip type line terminal 1110 of FIG. 11 in accordance with an exemplary embodiment of the present invention. The round stationary contact 1105 is placed in a center of a bond-facing surface of the C-clip type line terminal 1110. As noted above, the round stationary contact 1105 and the C-clip type line terminal 1110 are made of different materials which are bonded together by the silver nanoparticles (Np—Ag) material 200 which forms the nanoparticles joint 20 in between them via a welding process.

Figure 13:
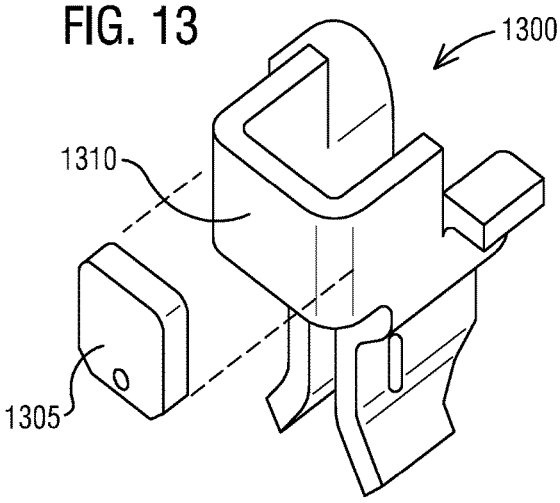
FIG. 13 illustrates a perspective view of a manufacturing setup of making an assembly of a square stationary contact and a C-clip type line terminal in accordance with an exemplary embodiment of the present invention.
Figure 14:
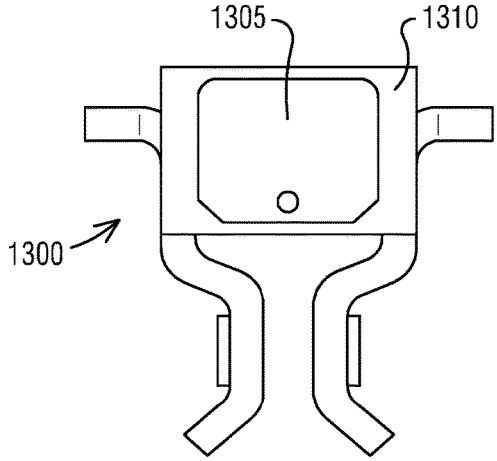
FIG. 14 illustrates a front view of an assembly of the square stationary contact and the C-clip type line terminal of FIG. 13 in accordance with an exemplary embodiment of the present invention.

FIG. 13 illustrates a perspective view of a manufacturing setup of making an assembly 1300 (shown in FIG. 14) of a square stationary contact 1305 and a C-clip type line terminal 1310 in accordance with an exemplary embodiment of the present invention. The square stationary contact 1305 is provided with a built-in hole 1315. FIG. 14 illustrates a front view of the assembly 1300 of the square stationary contact 1305 and the C-clip type line terminal 1310 of FIG. 13 in accordance with an exemplary embodiment of the present invention.

Figure 15:
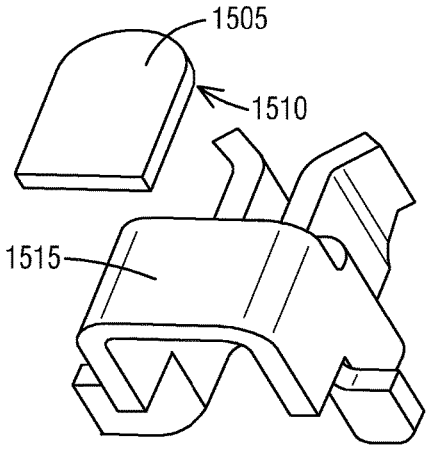
FIG. 15 illustrates a perspective view of a manufacturing setup of making an assembly of a stationary contact with a serrated edge or surface having serrations as teeth or points and a C-clip type line terminal in accordance with an exemplary embodiment of the present invention.

FIG. 15 illustrates a perspective view of a manufacturing setup of making an assembly 1500 (shown in FIG. 16) of a tablet stationary contact 1505 with a serrated edge or surface 1510 having serrations as teeth or points and a C-clip type line terminal 1515 in accordance with an exemplary embodiment of the present invention. The tablet stationary contact 1505 is bigger in size than a bond-facing surface of the C-clip type line terminal 1515 such that a portion of the tablet stationary contact 1505 extends beyond the bond-facing surface of the C-clip type line terminal 1515.

Figure 16:
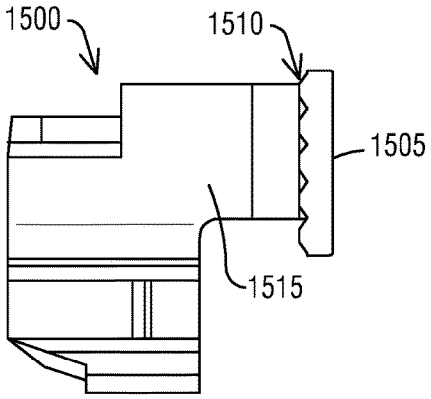
FIG. 16 illustrates a front view of an assembly of the stationary contact and the C-clip type line terminal of FIG. 15 in accordance with an exemplary embodiment of the present invention.

FIG. 16 illustrates a front view of the assembly 1500 of the tablet stationary contact 1505 and the C-clip type line terminal 1515 of FIG. 15 in accordance with an exemplary embodiment of the present invention. This assembly 1500 is provided with a U-shaped steel spring clip to increase contact pressure. A contact surface must not be damaged in welding process and a silver surface must remain intact. The solder flow must not touch the contact surface.

Figure 17:
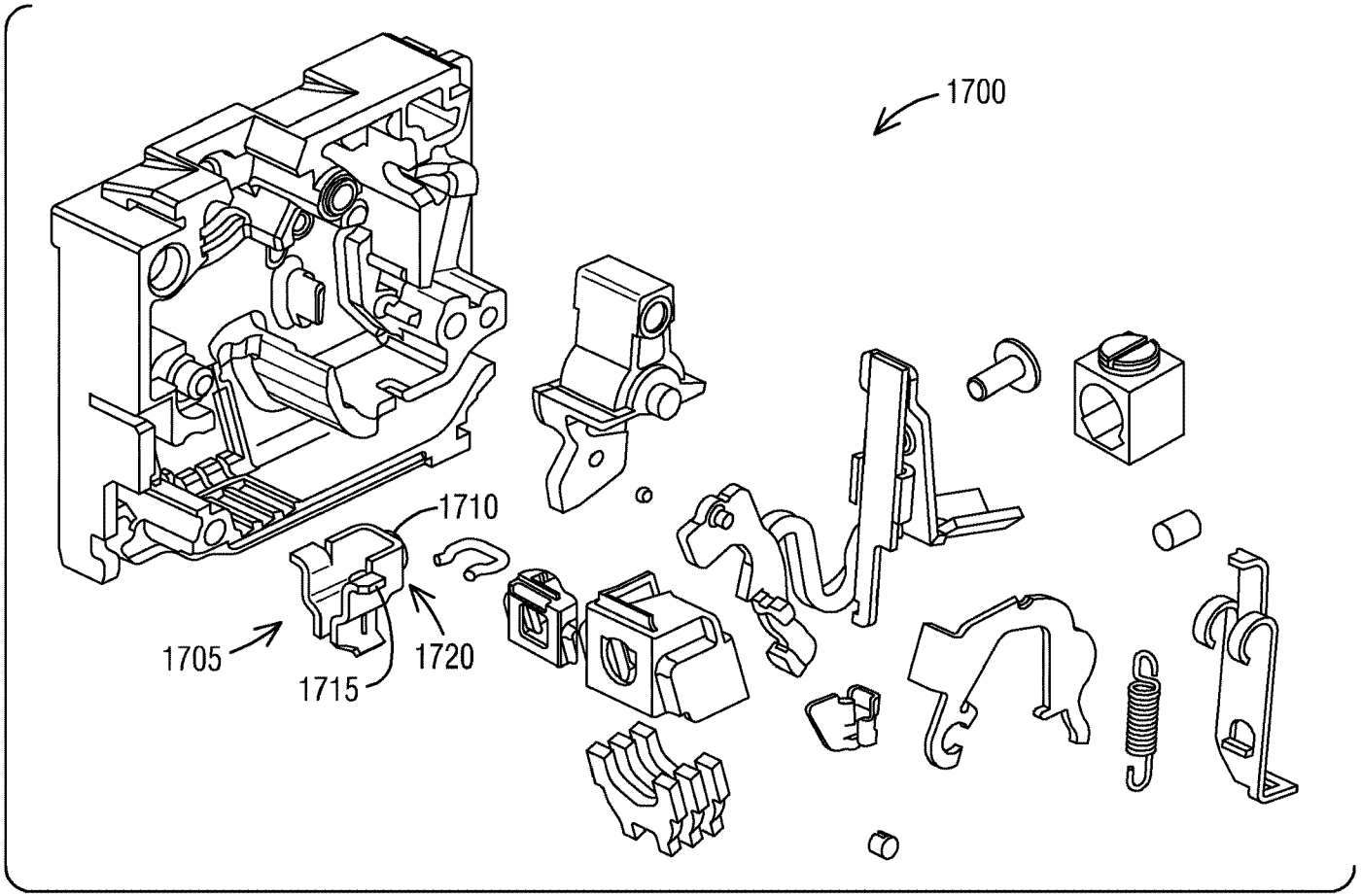
FIG. 17 illustrates an exploded view of a circuit breaker including an assembly of a stationary contact and a C-clip type line terminal in accordance with an exemplary embodiment of the present invention.

FIG. 17 illustrates an exploded view of a circuit breaker 1700 including an assembly 1705 of a stationary contact 1710 and a C-clip type line terminal 1715 in accordance with an exemplary embodiment of the present invention. The circuit breaker 1700 comprises the stationary contact 1710 configured to electrically connect with a connector such as a moving or movable contact in operation of the circuit breaker 1700. The circuit breaker 1700 further comprises the C-clip type line terminal 1715 configured to connect with the stationary contact 1710 by a direct physical contact or connection formed as a joint or a union by the silver nanoparticles (Np—Ag) material 200.

The stationary contact 1710 may comprise a silver alloy material and have a first surface (not seen). The C-clip type line terminal 1715 comprises a non-ferrous material and have a second surface (not seen) such that a plurality of drops of the silver nanoparticles (Np—Ag) material 200 may be applied in an interface 1720 between the first surface of the stationary contact 1710 and the second surface of the C-clip type line terminal 1715 by performing a resistance projection welding (RPW) as described earlier. In one embodiment, the stationary contact 1710 comprises 50% tungsten (W) and 50% Silver (Ag) and the C-clip type line terminal 1715 comprises a Copper (Cu) line terminal with an electrolytic coating of Silver (Ag) thereon.

The circuit breaker 1700 embodies a complete enclosure in a molded case insulating material. This provides mechanically strong and insulated housing. The switching system consists of a fixed and a moving contact to which incoming and outgoing wires are connected.

Figure 18:
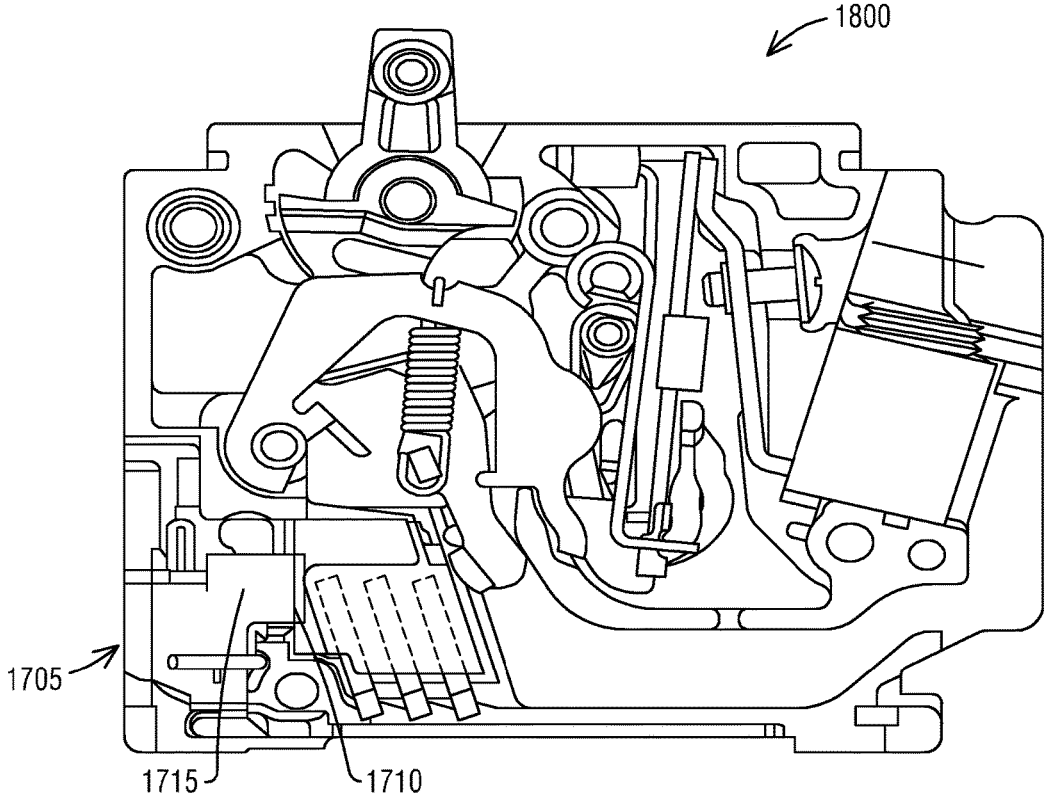
FIG. 18 illustrates a front view without a cover of a circuit breaker including an assembly of a stationary contact and a C-clip type line terminal in accordance with an exemplary embodiment of the present invention.

FIG. 18 illustrates a front view without a cover of a circuit breaker 1800 including the assembly 1705 of the stationary contact 1710 and the C-clip type line terminal 1715 in accordance with an exemplary embodiment of the present invention. The circuit breaker 1800 may be an automatically operated electrical switch designed to protect an electrical circuit from damage caused by excess current, typically resulting from an overload or short circuit. Its basic function is to interrupt current flow after a fault is detected. Unlike a fuse, which operates once and then must be replaced, a circuit breaker can be reset (either manually or automatically) to resume normal operation. Circuit breakers are made in varying sizes, from small devices that protect low-current circuits or individual household appliance, up to large switchgear designed to protect high voltage circuits feeding an entire city. The generic function of a circuit breaker is to provide an automatic means of removing power from a faulty system.

A wide array of thermal-magnetic circuit breakers is the key element for overload and short-circuits protection of a home's electrical system. To provide additional protection circuit breakers can also protect against severe electrical shock or electrocution, mitigate the risk of electrical fires and protect against damaging surges and voltage spikes.

Circuit breakers may be of various types such as residential circuit breakers, molded case circuit breakers, power circuit preachers or control circuit protection. Residential circuit breakers are intended for switching and protection of your home's wiring from high temperatures caused by excess current higher than the rating of the wire. While thermal-magnetic circuit breakers are the key element for overload and short-circuit protection of your electrical system, there are potentially dangerous conditions that do not involve over current. Special circuit breakers may be utilized to provide further protection.

While a multi-pole residential electronic circuit breaker is described here as a regular thermal/magnetic residential circuit breaker a range of other constructions of circuit breakers are also contemplated by the present invention. For example, a ground fault circuit interrupter (GFCI) and/or combination arc-fault circuit interrupting (CAFCI) two or three pole residential circuit breaker may be implemented based on one or more features presented above without deviating from the spirit of the present invention.

A ground fault circuit interrupter (GFCI), also called Ground Fault Interrupter (GFI) or Residual Current Device (RCD) is a device that shuts off an electric power circuit when it detects that current is flowing along an unintended path. A GFCI works by measuring the current leaving one side of a power source (the so-called "live" or "hot wire"), and comparing it to current returning on the other (the "neutral" side). If they are not equal, then some of the current must be leaking in an unwanted way, and the GFCI shuts the power off. After the problem is fixed, the device must be reset manually by pushing the reset button. If the problem is not fixed, the GFCI will keep shutting off. GFCIs are available in two types for permanent installation: the circuit breaker type that installs in an electrical panel, and the receptacle type that installs in a normal electrical outlet box. GFCIs that attach to appliance cords, or are built in to extension cords, are also available. The CAFCI is a new version of the older ACFI breaker. An arc fault circuit interrupter (AFCI) is an advanced circuit breaker that, as a way to reduce electrical fire threats, breaks the circuit when it detects a dangerous electric arc in the circuit that it protects. Breakers designed to protect against parallel and series arcs are called Combination Arc-Fault Circuit Breakers. Both trip like a standard circuit breaker when the circuit is overloaded with too much current or there is a short circuit, and the AFCI also trips when there is parallel arcing (hot-to-neutral or an arc to ground) in the protected circuit.

Figure 19:
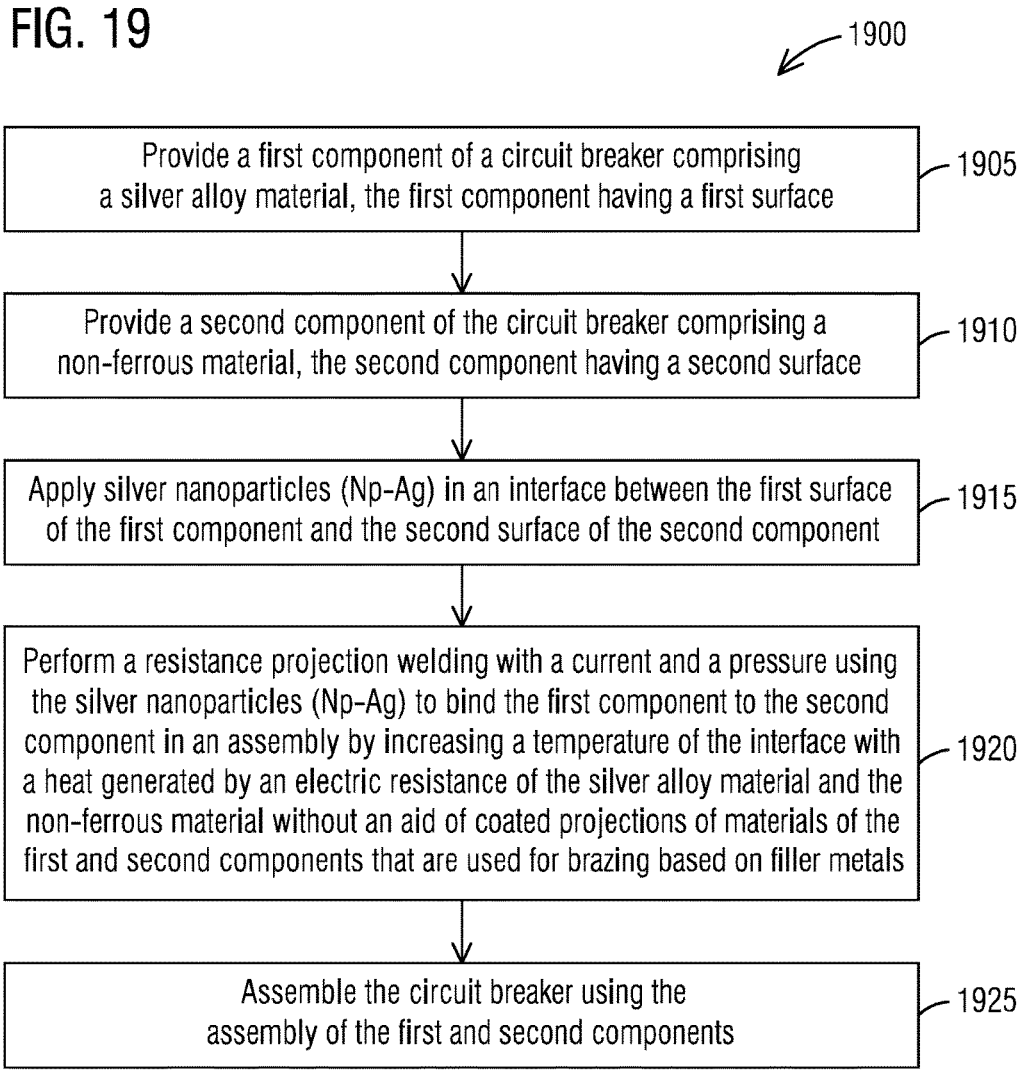
FIG. 19 illustrates a flow chart of a method of assembling two components of a circuit breaker with a silver nanoparticles material according to an exemplary embodiment of the present invention.

FIG. 19 illustrates a flow chart of a method 1900 of assembling the two components 10(1-2) of the circuit breaker 1800 with the silver nanoparticles material 200 according to an exemplary embodiment of the present invention. Reference is made to the elements and features described in FIGS. 1-18. It should be appreciated that some steps are not required to be performed in any particular order, and that some steps are optional.

The method 1900 comprises a step 1905 of providing the first component 10(1) of the circuit breaker 1800 comprising a silver alloy material. The first component 10(1) may have a first surface. The method 1900 comprises a step 1910 of providing the second component 10(2) of the circuit breaker 1800 comprising a non-ferrous material. The second component 10(2) may have a second surface. The method 1900 comprises a step 1915 of applying the silver nanoparticles (Np—Ag) material 200 in an interface between the first surface of the first component 10(1) and the second surface of the second component 10(2).

The method 1900 comprises a step 1920 of performing a resistance projection welding with a current and a pressure using the silver nanoparticles (Np—Ag) material 200 to bind the first component 10(1) to the second component 10(2) in an assembly by increasing a temperature of the interface with a heat generated by an electric resistance of the silver alloy material and the non-ferrous material without an aid of coated projections of materials of the first and second components that are used for brazing based on filler metals such as the SL-FOS®. The method 1900 comprises a step 1925 of assembling the circuit breaker 1800 using the assembly of the first and second components 10(1-2).

In the method 1900 of FIG. 19, providing the first component 10(1) of the circuit breaker 1800 further comprises providing a stationary contact of the circuit breaker 1800. In the method 1900 of FIG. 19, providing a contact of the circuit breaker 1800 further comprises forming the contact of the silver alloy material by using 50% tungsten (W) and 50% Silver (Ag). In the method 1900 of FIG. 19, providing the second component 10(2) of the circuit breaker 1800 further comprises providing a line terminal of the circuit breaker 1800.

In the method 1900 of FIG. 19, providing the line terminal of the circuit breaker 1800 further comprises forming the line terminal of the non-ferrous material by an electrolytic coating of Silver (Ag) on a Copper (Cu) line terminal. In the method 1900 of FIG. 19, applying the silver nanoparticles (Np—Ag) material 200 in an interface further comprises synthesizing the silver nanoparticles (Np—Ag) material 200 using a green chemistry methodology to obtain a nanomaterial from non-polluting compounds. In the method 1900 of FIG. 19, synthesizing the silver nanoparticles (Np—Ag) material 200 using a green chemistry methodology further comprises reducing a silver ion complex as a precursor salt to a colloidal silver in a presence of a reducing agent.

In the method 1900 of FIG. 19, reducing the silver ion complex as the precursor salt to the colloidal silver in the presence of the reducing agent further comprises reducing a solution of Silver Nitrate ($AgNO_3$) with a coriander leaf extract as the reducing agent. In the method 1900 of FIG. 19, applying the silver nanoparticles (Np—Ag) material 200 in an interface further comprises depositing the silver nanoparticles (Np—Ag) material 200 on the first surface of the contact of 50% tungsten (W) and 50% Silver (Ag) to prepare a surface of a bond. In the method 1900 of FIG. 19, depositing the silver nanoparticles (Np—Ag) material 200 further comprises depositing a plurality of drops of the silver nanoparticles (Np—Ag) material 200 between the first and second surfaces to form the bond.

The method 1900 of FIG. 19 further comprises drying the first and second surfaces of the bond by the use of a large cast iron plate or a griddle. The silver nanoparticles (Np—Ag) in a solution may be of a size in a range of 400-500 nm. The current of 14 kA may be used. The pressure of 0.1 MPa may be used. In the method 1900 of FIG. 19, applying the silver nanoparticles (Np—Ag) material 200 in an interface further comprises applying and drying 7 or 13 drops of the silver nanoparticles (Np—Ag) material 200 to obtain a mechanical strength of 339-440 lbs.

Figure 20:
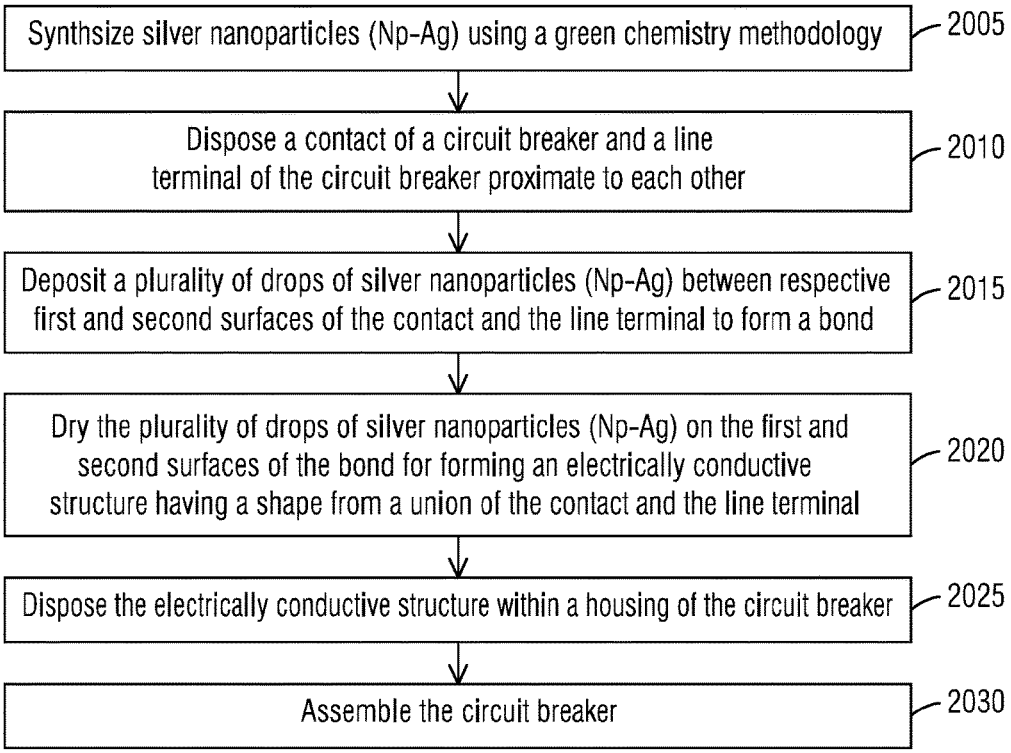
FIG. 20 illustrates a flow chart of a method of assembling two components of a circuit breaker with a silver nanoparticles material according to another exemplary embodiment of the present invention.

FIG. 20 illustrates a flow chart of a method 2000 of assembling the two components 10(1-2) of the circuit breaker 1800 with the silver nanoparticles (Np—Ag) material 200 according to another exemplary embodiment of the present invention. Reference is made to the elements and features described in FIGS. 1-18. It should be appreciated that some steps are not required to be performed in any particular order, and that some steps are optional.

The method 2000 comprises a step 2005 of synthesizing the silver nanoparticles (Np—Ag) material 200 using a green chemistry methodology. The method 2000 further comprises a step 2010 of disposing a contact of the circuit breaker 1800 and a line terminal of the circuit breaker 1800 proximate to each other. The method 2000 further comprises a step 2015 of depositing a plurality of drops of the silver nanoparticles (Np—Ag) material 200 between respective first and second surfaces of the contact and the line terminal to form a bond.

The method 2000 further comprises a step 2020 of drying the plurality of drops of the silver nanoparticles (Np—Ag) material 200 on the first and second surfaces of the bond for forming an electrically conductive structure having a shape from a union of the contact and the line terminal. The plurality of drops of silver nanoparticles (Np—Ag) comprises 7 or 13 drops. The method 2000 further comprises a step 2025 of disposing the electrically conductive structure within a housing of the circuit breaker 1800. The method 2000 further comprises a step 2030 of assembling the circuit breaker 1800. The method 2000 further comprises applying a current of 14 kA and applying a pressure of 0.1 MPa in a resistance projection welding process to form the union through resistance welding of the contact and the line terminal by applying the silver nanoparticles (Np—Ag) material 200 in an interface between the first surface of the contact and the second surface of the line terminal.

Figure 21:
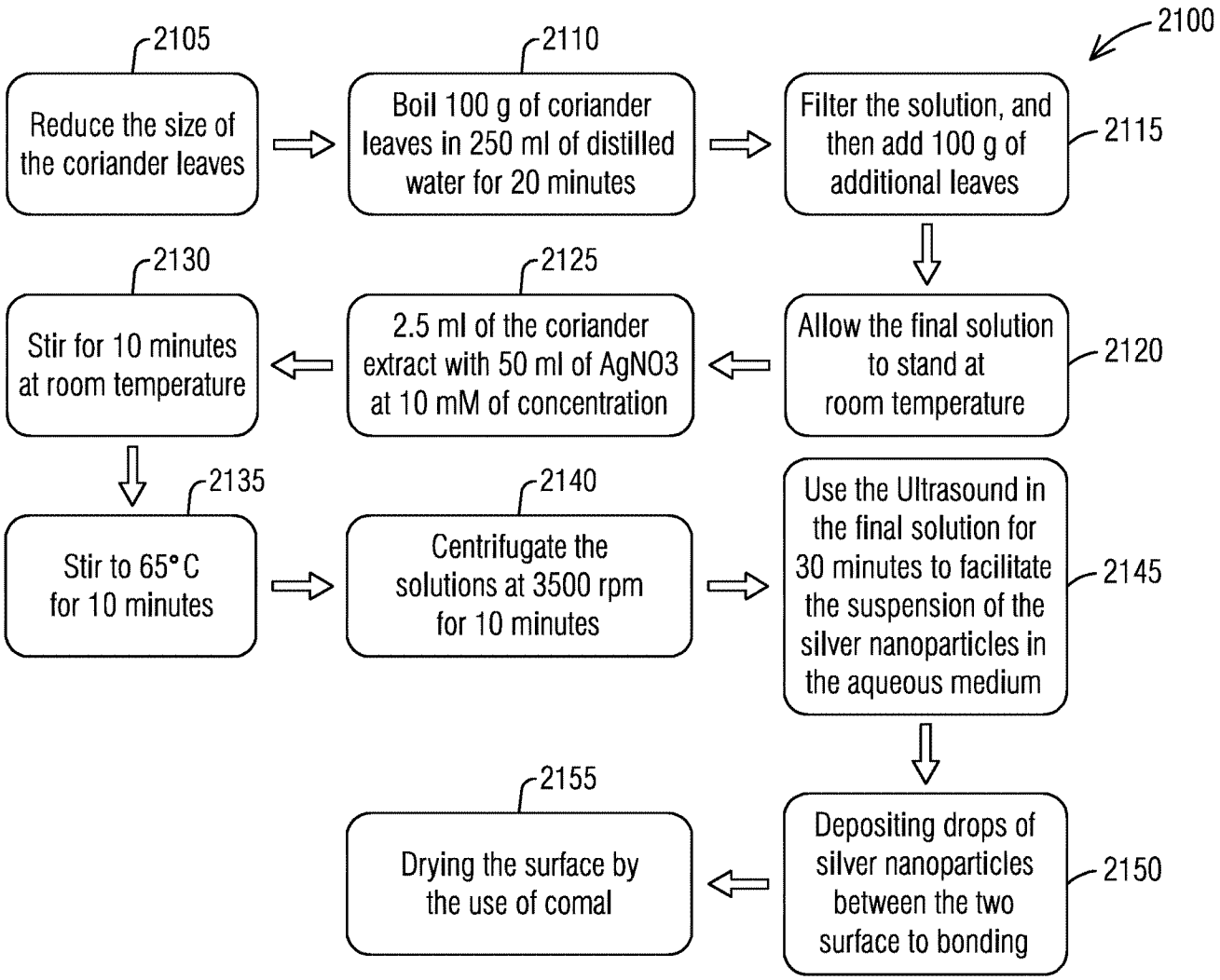
FIG. 21 illustrates a flow chart of a method of assembling two components of a circuit breaker with a silver nanoparticles material according to yet another exemplary embodiment of the present invention.

FIG. 21 illustrates a flow chart of a method 2100 of assembling the two components 10(1-2) of the circuit breaker 1800 with the silver nanoparticles (Np—Ag) material 200 according to yet another exemplary embodiment of the present invention. Reference is made to the elements and features described in FIGS. 1-18. It should be appreciated that some steps are not required to be performed in any particular order, and that some steps are optional.

The method 2100 further comprises a step 2105 of reducing the size of coriander leaves. The method 2100 further comprises a step 2110 of boiling 100 gm of coriander leaves in 250 ml of distilled water for 20 minutes to form a solution. The method 2100 further comprises a step 2115 of filtering the solution and then adding 100 gm of additional coriander leaves to form a final solution. The method 2100 further comprises a step 2120 of allowing the final solution to stand at room temperature. The method 2100 further comprises a step 2125 of mixing a 2.5 ml of coriander extract with a 50 ml of AgNO3 at 10 mM of concentration. The method 2100 further comprises a step 2130 of stirring for 10 minutes at room temperature. The method 2100 further comprises a step 2135 of stirring to 65° C. for 10 minutes. The method 2100 further comprises a step 2140 of centrifugating the solutions at 3500 rpm for 10 minutes. The method 2100 further comprises a step 2145 of using an Ultrasound in the final solution for 30 minutes to facilitate the suspension of the silver nanoparticles material 200 in the aqueous medium. The method 2100 further comprises a step 2150 of depositing drops of the silver nanoparticles material 200 between the two surfaces to bonding. The method 2100 further comprises a step 2155 of drying the surface by the use of a comal.

The techniques described herein can be particularly useful for binding a contact and a line terminal of a circuit breaker. While particular embodiments are described in terms of the contact and the line terminal, the techniques described herein are not limited to the contact and the line terminal but can also be used for binding other components of a circuit breaker or otherwise.

While embodiments of the present invention have been disclosed in exemplary forms, it will be apparent to those skilled in the art that many modifications, additions, and deletions can be made therein without departing from the spirit and scope of the invention and its equivalents, as set forth in the following claims.

Embodiments and the various features and advantageous details thereof are explained more fully with reference to the non-limiting embodiments that are illustrated in the accompanying drawings and detailed in the following description. Descriptions of well-known starting materials, processing techniques, components and equipment are omitted so as not to unnecessarily obscure embodiments in detail. It should be understood, however, that the detailed description and the specific examples, while indicating preferred embodiments, are given by way of illustration only and not by way of limitation. Various substitutions, modifications, additions and/or rearrangements within the spirit and/or scope of the underlying inventive concept will become apparent to those skilled in the art from this disclosure.

As used herein, the terms "comprises," "comprising," "includes," "including," "has," "having" or any other variation thereof, are intended to cover a non-exclusive inclusion. For example, a process, article, or apparatus that comprises a list of elements is not necessarily limited to only those elements but may include other elements not expressly listed or inherent to such process, article, or apparatus.

Additionally, any examples or illustrations given herein are not to be regarded in any way as restrictions on, limits to, or express definitions of, any term or terms with which they are utilized. Instead, these examples or illustrations are to be regarded as being described with respect to one particular embodiment and as illustrative only. Those of ordinary skill in the art will appreciate that any term or terms with which these examples or illustrations are utilized will encompass other embodiments which may or may not be given therewith or elsewhere in the specification and all such embodiments are intended to be included within the scope of that term or terms.

In the foregoing specification, the invention has been described with reference to specific embodiments. However, one of ordinary skill in the art appreciates that various modifications and changes can be made without departing from the scope of the invention. Accordingly, the specification and figures are to be regarded in an illustrative rather than a restrictive sense, and all such modifications are intended to be included within the scope of invention.

Although the invention has been described with respect to specific embodiments thereof, these embodiments are merely illustrative, and not restrictive of the invention. The description herein of illustrated embodiments of the invention is not intended to be exhaustive or to limit the invention to the precise forms disclosed herein (and in particular, the inclusion of any particular embodiment, feature or function is not intended to limit the scope of the invention to such embodiment, feature or function). Rather, the description is intended to describe illustrative embodiments, features and functions in order to provide a person of ordinary skill in the art context to understand the invention without limiting the invention to any particularly described embodiment, feature or function. While specific embodiments of, and examples for, the invention are described herein for illustrative purposes only, various equivalent modifications are possible within the spirit and scope of the invention, as those skilled in the relevant art will recognize and appreciate. As indicated, these modifications may be made to the invention in light of the foregoing description of illustrated embodiments of the invention and are to be included within the spirit and scope of the invention. Thus, while the invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the invention.

Respective appearances of the phrases "in one embodiment," "in an embodiment," or "in a specific embodiment" or similar terminology in various places throughout this specification are not necessarily referring to the same embodiment. Furthermore, the particular features, structures, or characteristics of any particular embodiment may be combined in any suitable manner with one or more other embodiments. It is to be understood that other variations and modifications of the embodiments described and illustrated herein are possible in light of the teachings herein and are to be considered as part of the spirit and scope of the invention.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

It will also be appreciated that one or more of the elements depicted in the drawings/figures can also be implemented in a more separated or integrated manner, or even removed or rendered as inoperable in certain cases, as is useful in accordance with a particular application.

Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component.

What is claimed is:

1. A circuit breaker, comprising:

a contact configured to electrically connect with a connector; and a line terminal configured to connect with the contact by a direct physical contact, wherein the contact comprising a silver alloy material of a first metal and Silver (Ag) and having a first surface, the line terminal comprising a non-ferrous material of a second metal with an electrolytic coating of Silver (Ag) thereon and having a second surface wherein a plurality of drops of silver nanoparticles (Np—Ag) are applied in an interface between the first surface of the contact and the second surface of the line terminal and through resistance projection welding the silver nanoparticles (Np—Ag) having a particle size between 1 nm and 100 nm form a bond with the Silver (Ag) of the contact and the Silver (Ag) of the line terminal.

2. The circuit breaker of claim 1, wherein the contact comprises 50% tungsten (W) and 50% Silver (Ag) and the line terminal comprises a Copper (Cu) line terminal with an electrolytic coating of Silver (Ag) thereon.

3. A method of joining two electrically conductive components assembled within a circuit breaker, comprising:

providing a first component of the circuit breaker comprising a silver alloy material of a first metal and Silver (Ag), the first component having a first surface;

providing a second component of the circuit breaker comprising a non-ferrous material of a second metal with an electrolytic coating of Silver (Ag) thereon, the second component having a second surface;

applying silver nanoparticles (Np—Ag) having a particle size between 1 nm and 100 nm in an interface between the first surface of the first component and the second surface of the second component by depositing a plurality of drops of the silver nanoparticles (Np—Ag) between the first and second surfaces to form a bond between Silver (Ag) portions of the first, second component and the applied silver nanoparticles (Np—Ag);

performing a resistance projection welding using current and pressure and increasing a temperature of the interface with a heat generated by an electric resistance of the silver alloy material and the non-ferrous material without the use of additional materials such as coated projections of materials or brazing based on filler metals, such that the silver nanoparticles (Np—Ag) bind the first component to the second component in an assembly; and assembling the circuit breaker using the assembly of the first and second components.

4. The method of claim 3, wherein the current of 14 kA was used.

5. The method of claim 3, wherein the pressure of 0.1 MPa was used.

6. The method of claim 3, wherein providing a second component of the circuit breaker further comprising:

providing a line terminal of the circuit breaker.

7. The method of claim 6, wherein providing the line terminal of the circuit breaker further comprising:

forming the line terminal of the non-ferrous material by an electrolytic coating of Silver (Ag) on a Copper (Cu) line terminal.

8. The method of claim 3, wherein providing a first component of a circuit breaker further comprising:

providing a stationary contact of the circuit breaker.

9. The method of claim 8, wherein providing a contact of the circuit breaker further comprising:

forming the contact of the silver alloy material by using 50% tungsten (W) and 50% Silver (Ag).

10. The method of claim 9, wherein applying silver nanoparticles (Np—Ag) in an interface further comprising:

depositing the silver nanoparticles (Np—Ag) on the first surface of the contact of 50% tungsten (W) and 50% Silver (Ag) to prepare a surface of a bond.

* * * * *